US007380931B2

(12) United States Patent
Asanuma

(10) Patent No.: US 7,380,931 B2
(45) Date of Patent: Jun. 3, 2008

(54) INKJET TYPE RECORDING APPARATUS AND CONTROL METHOD OF THE SAME

(75) Inventor: Shoji Asanuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 364 days.

(21) Appl. No.: 11/209,505

(22) Filed: Aug. 23, 2005

(65) Prior Publication Data

US 2006/0044336 A1 Mar. 2, 2006

(30) Foreign Application Priority Data

Aug. 25, 2004 (JP) ..... 2004-244961

(51) Int. Cl.
*B41J 29/13* (2006.01)

(52) U.S. Cl. ..... 347/108; 347/14; 347/37

(58) Field of Classification Search ..... 347/14, 347/37, 19, 108
See application file for complete search history.

(56) References Cited

U.S. PATENT DOCUMENTS 5,100,119 A * 3/1992 Komada et al. ..... 270/58.14
5,844,687 A * 12/1998 Nagane et al. ..... 358/296
6,065,831 A * 5/2000 Kawaura et al. ..... 347/108
7,222,936 B2 * 5/2007 Griesemer et al. ..... 347/37

FOREIGN PATENT DOCUMENTS

JP 9-20017 1/1997
JP 2003-48330 2/2003

* cited by examiner

*Primary Examiner*—Thinh Nguyen
(74) *Attorney, Agent, or Firm*—Cooper & Dunham, LLP

(57) ABSTRACT

An inkjet recording apparatus includes a carriage having a printing head and moving in a main scanning direction, an exterior cover, and a detection part configured to detect an opening or closing state of the exterior cover. The carriage is returned to a home position when opening of the exterior cover is detected.

16 Claims, 6 Drawing Sheets

INKJET TYPE RECORDING APPARATUS AND CONTROL METHOD OF THE SAME

BACKGROUND OF THE INVENTION

1. Field of the Invention

The present invention relates to inkjet type recording apparatuses and control methods of the same, and more particularly, an inkjet recording apparatus and a control method of the same whereby danger at the time when a cover provided in the recording apparatus is opened is avoided and a printing head is prevented from being dried.

2. Description of the Related Art

It is necessary for a nozzle of a printing head of an inkjet type recording apparatus to be prevented from being dried. Therefore, in a case where a printing operation is not performed, a carriage where the printing head is provided should be positioned at a home position and the printing head be covered with capping means.

In addition, in a related art inkjet recording apparatus, a cartridge button is pushed or the cover of the recording apparatus is opened so that the carriage is moved from the home position to an exchange position and thereby it is easy to exchange the ink cartridge.

For example, the carriage being moved from the home position to the exchange position so that the cover can be opened by pushing the operation button so that a printing mode is switched to a maintenance mode is discussed at paragraph 0030 of Japan Laid-Open Patent Application Publication No. 2003-48330.

In addition, Japan Laid-Open Patent Application Publication No. 9-20017 discloses that the carriage is moved from the home position to the exchange position by opening the cover of the recording apparatus in a state where the remaining ink amount is smaller than a certain amount.

However, a hand of an operator may touch a paper conveyance part or a recording part in order to exchange the ink cartridge or for a jam clearing process, so that the hand or a finger may be injured.

Furthermore, if a state where the cover is opened and the carriage is positioned at the exchange position is left as it is, the nozzle of the printing head becomes dried.

SUMMARY OF THE INVENTION

Accordingly, it is a general object of the present invention to provide a novel and useful inkjet recording apparatus and control method of the same whereby danger at the time when a cover provided in the recording apparatus is opened is avoided and a printing head is prevented from being dried.

The above object of the present invention is to provide an inkjet recording apparatus, including:

a carriage having a printing head and moving in a main scanning direction;

an exterior cover; and a detection part configured to detect an opening or closing state of the exterior cover;

wherein the carriage is returned to a home position when opening of the exterior cover is detected.

The above object of the present invention is also to provide a control method of an inkjet recording apparatus, the inkjet recording apparatus including a carriage having a printing head and moving in a main scanning direction, an exterior cover configured to open an ink cartridge installation part, and a detection part configured to detect an opening or closing state of the exterior cover, the control method including the step of:

returning the carriage to a home position when opening of the exterior cover is detected by the detection part.

According to the above-mentioned invention, since when opening of the exterior cover is detected, the carriage is returned to the home position, and the nozzle of the printing head is prevented from being dried.

Under a structure where electric power of a paper conveying group is turned off when the exterior cover is opened, even if a conveying part cover is opened, a finger of the operator is not caught in the apparatus so that danger to the user is avoided.

In a case where the opening of the exterior cover, the conveying part cover, and an engine part cover is determined in this order and the electric power of the engine part is turned off when the engine part cover is opened, danger in the paper conveying part and the engine part can be securely avoided.

Since the carriage is returned to the home position when the engine part cover is opened, drying of the nozzle of the printing head is surely prevented.

Other objects, features, and advantages of the present invention will become more apparent from the following detailed description when read in conjunction with the accompanying drawings.

DETAILED DESCRIPTION OF THE PREFERRED EMBODIMENTS

A description of the present invention is now given, with reference to FIG. 1 through FIG. 7, including embodiments of the present invention.

Figure 1:
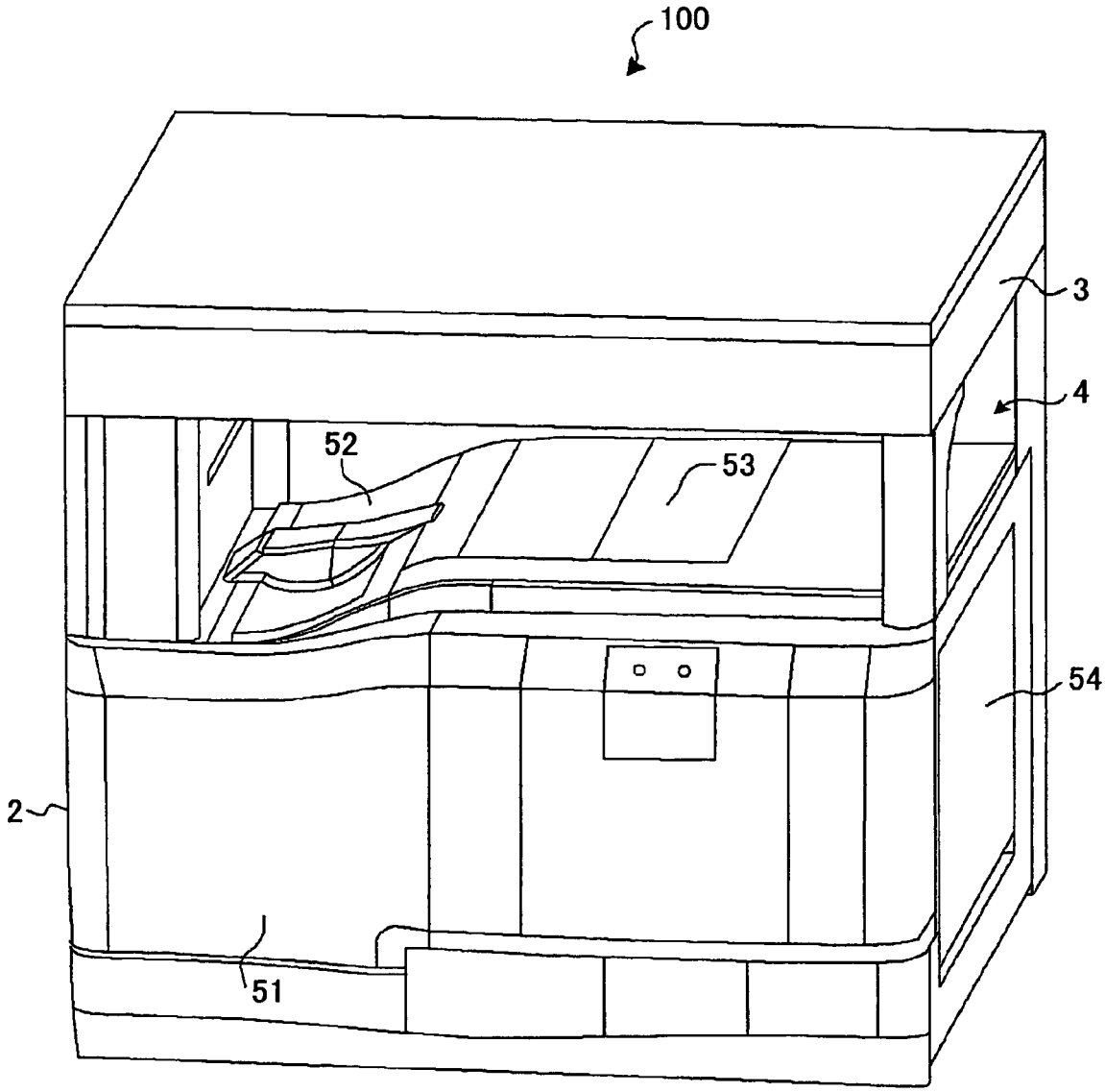
FIG. 1 is a perspective view of an inkjet copier of an example of a recording apparatus of the present invention.
Figure 2:
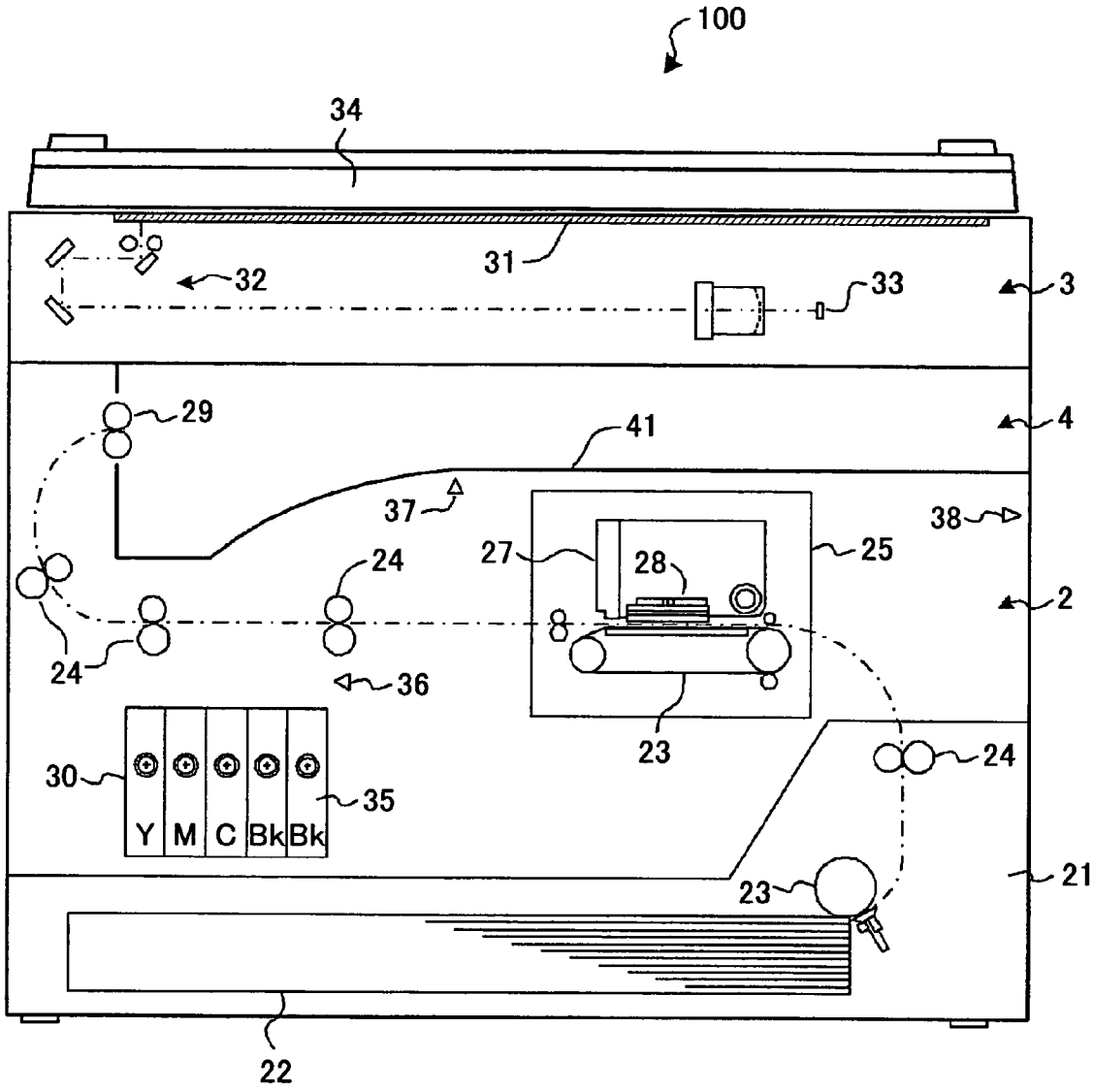
FIG. 2 is a cross-sectional view showing an inside structure of the inkjet copier shown in FIG. 1.

FIG. 1 is a perspective view of an inkjet copier of an example of a recording apparatus of the present invention. FIG. 2 is a cross-sectional view showing an inside structure of the inkjet copier shown in FIG. 1. As shown in FIG. 1 and FIG. 2, the inkjet copier 100 of this example has a structure where a printer part 2 is provided at a lower part of the inkjet copier 100, a scanner part 3 is provided at an upper part of the inkjet copier 100, and a paper discharge part 4 is put between the printer part 2 and the scanner part 3. The inkjet copier 100 may be a multiple function processing machine having both a printer function and a facsimile function.

In the scanner part 3, a scanning part 32 is movably provided below a contact glass 31. The scanner part 3 leads a reflection light from a manuscript lighted by a lighting source to a CCD 33 via a mirror lens or the like so that an image in the manuscript is read. A pressing plate 34 is provided on the contact glass 31 so as to be capable of being opened and closed.

The printer part 2 has a structure where a paper feeding part 21 provided at a lower part of the printer part 2, and an ink jet engine 25 and an ink cartridge installation part 30 are provided at an upper part of the printer part 2. A paper cassette 22 receiving a recording medium such as a transfer paper, a paper feeding part 23 for feeding paper one by one from the paper cassette, and others are provided in the paper feeding part 21. A recording paper conveying path from the paper feeding part 21 to the paper discharge part 4 is formed as shown by an alternating long and short dash line in FIG. 2. Conveying rollers 24 are provided at designated positions in the recording paper conveying path. A paper is discharged by a discharge roller 29 to a discharge paper tray 41.

The ink jet engine 25 applies a paper conveying system using an electrostatic attraction belt 26 whereby paper can be sent more stably than the conventional roller conveying type. The carriage 27 having the printing head 28 reciprocates in a main scanning direction, namely a direction perpendicular to the plane containing the drawing of FIG. 2 so as to perform printing. The printing head 28 has a nozzle line length of 3.23 cm (1.27 inches) longer than the conventional art. In this example, the printing head 28 has a four-head structure where each color of yellow (Y), magenta (M), cyan (C), and black (Bk) has a single head. The number of the heads is not limited to four. For example, a two-head structure where two colors form a single head may be used.

In the inkjet copier 100 of this example, ink cartridges 35 for respective colors are provided separately from the printing head. Inks in the cartridges 35 are supplied to the printing head 28 via a supply tube (not shown). The ink cartridges 35 for respective colors being provided separately from the printing head is proper for business use in that it is possible to use a mass capacity type cartridge corresponding to the increase of consumption of the ink based on a high speed printer. Furthermore, in this example, two pieces of the ink cartridges for black color (Bk) whose consumption amount is large can be provided. Therefore five pieces of the ink cartridges 35 including ink cartridges for colors yellow (Y), magenta (M), and cyan (C) are provided in the cartridge installation part 30.

Figure 3:
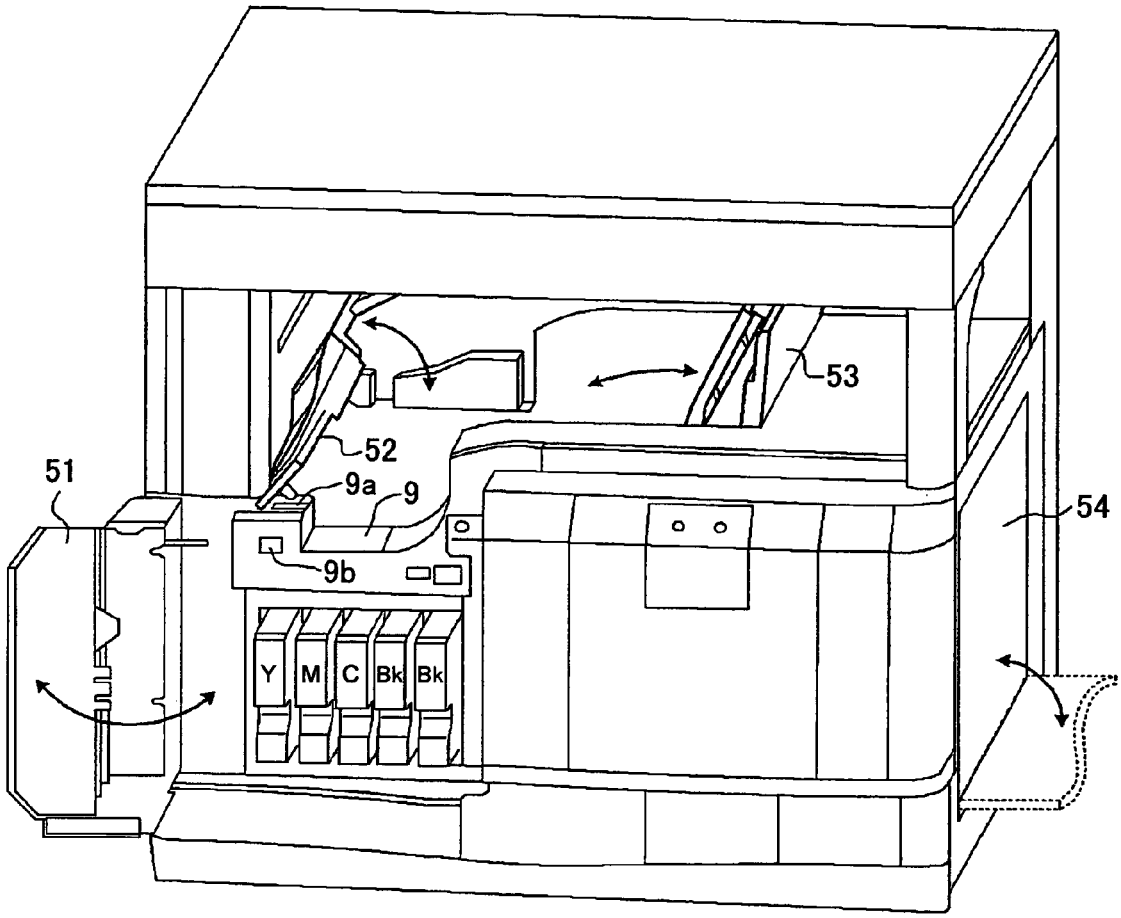
FIG. 3 is a perspective view of the inkjet copier shown in FIG. 1 in a state where covers of the inkjet copier are opened.

A front cover 51 provided at a front surface of the inkjet copier 100 is a folding type cover configured to be opened for exchanging the ink cartridge 35. As shown in FIG. 3, if the front cover 51 is opened, the ink cartridges 35 set in the cartridge installation part 30 become visible. A sensor 36 (See FIG. 2) is provided so as to detect an opening or closing state of the front cover 51.

The conveying cover 52 and the engine cover 53 are members for forming the paper discharge tray 41 and provided for partitioning between the printer part 2 and the paper discharge part 4. A state where the conveying cover 52 and the engine cover 53 are opened is shown in FIG. 3. When the conveying cover 52 is opened, the paper conveying path at a downstream side of the engine part can be accessed. When the engine cover 53 is opened, an upper surface of the inkjet engine part 25 can be opened. In a case where jamming occurs at the paper conveying path at the downstream side of the engine part, the conveying cover 52 and the engine cover 53 are opened for a jam clearing process. In this example, a sensor 37 (See FIG. 2) is provided for detecting the opening or closing state of the engine cover 53.

If the side cover 54 is opened, it is possible to access to the paper conveying path from the paper feeding part 21 to the ink jet engine 25. In a case where jamming is generated in this part, the side cover 54 is opened for the jam clearing process. A sensor 38 (See FIG. 2) is provided so as to detect the opening or closing state of the side cover 54.

Figure 4:
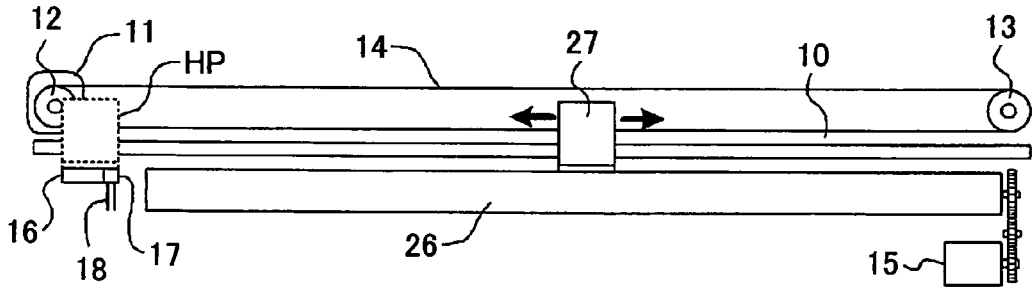
FIG. 4 is a front view of an inkjet engine part.

FIG. 2 is a front view of the inkjet engine part 25. FIG. 3 is a perspective view seen from a left direction as viewed from FIG. 2. Therefore, the left side of FIG. 4 shows a back side of the inkjet copier and the right side of FIG. 4 shows a front side of the inkjet copier. The carriage 27 having a printing head 28 (shown in FIG. 2) is slide-ably provided on a guide rod 10. In order to move the carriage 27 in a main scanning direction, a timing belt 14 is stretched around a driving pulley 12 driven by a main scanning motor 11 and an idler pulley 13. The carriage 27 is attached to the timing belt 14 and is reciprocated in directions shown by arrows in FIG. 4 by rotating the main scanning motor 11 clockwise and counter-clockwise. The electrostatic attraction belt 26 sending the paper in a sub-scanning direction is rotated by the sub-scanning motor 15 via a driving system such as a gear line.

In the inkjet copier 100 of this example, the inkjet engine part 25 has an operating voltage of 37 V. The main scanning motor 11 and the sub-scanning motor 15 are driven by the voltage of 37 V. The paper conveying system from the paper feeding part 21 to the paper discharge part 4 has an operating voltage of 24 V. A conveying motor (not shown in FIG. 2) configured to drive a paper feeding roller as a paper feeding part 23, conveying rollers 24 provided at the conveying path, and paper discharge rollers 29 are driven by the voltage of 24 V. The operating voltage is not limited to the above-mentioned 37 V or 24 V. Any operating voltage may be used. Three or more voltage values may be used. For example, in the inkjet copier of this example, an operating voltage of a sensor configured to detect opening or closing of covers such as a front cover 51 or a conveying cover 52 is set to be 5 V. The voltage does not have to be a fixed value since the voltage may be changed depending on the workload.

Referring back to FIG. 4, a home position HP (shown by a dotted line in FIG. 4) of the carriage 27 is provided at a position separated from a writing area at a left end side in a moving direction of the carriage 27. Capping parts 16 and 17 are provided so that the capping parts 16 and 17 seal a nozzle part of a printing head 28 when the carriage 27 stops at the home position HP. A tube 18 connected to a suction pump (not shown) is provided at the capping part 17 for cleaning the nozzle part in a case where bad jetting (improper ink discharge) is generated.

Figure 5:
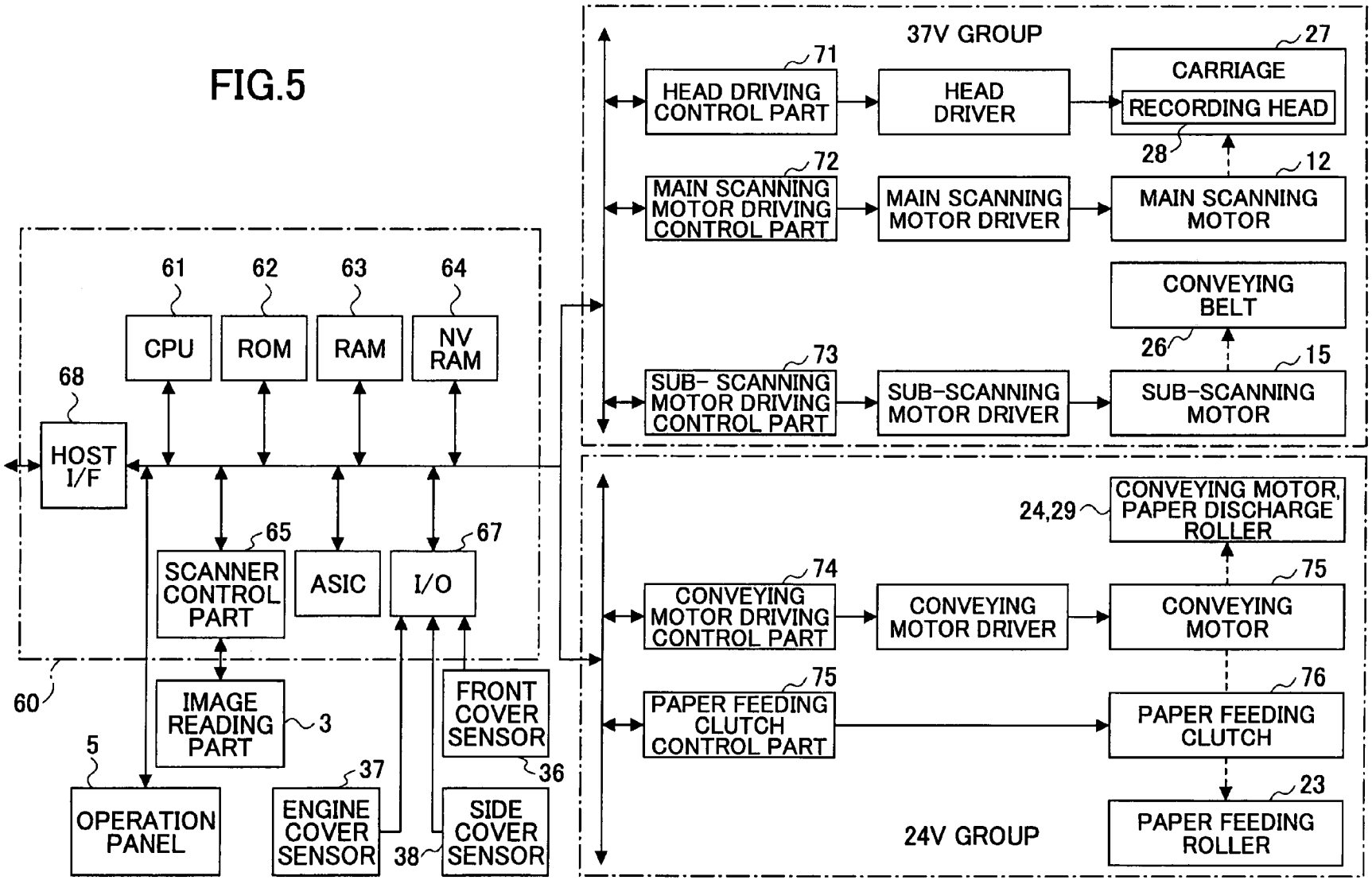
FIG. 5 is a block diagram showing a structure of a control part of the inkjet copier.

FIG. 5 is a block diagram showing a structure of a control part of the inkjet copier 100. A system control part 60 includes a CPU 61, a ROM 62, a RAM 63, a non-volatile RAM (NVRAM) 64, a scanner control part 65, an ASIC 66, I/O 67, a host IF 68, and others. In FIG. 5, a part driven by the operating voltage of 37 V and a part driven by the operating voltage of 24 V are respectively surrounded by frames.

A scanner control part 65 controls an image reading part (scanner part) 3. Outputs from the front cover sensor 36, the engine cover sensor 37 and the side cover sensor 38 are input to the I/O 67. The host interface 68 exchanges data and control signals with an external machine such as a personal computer. Input and output via an operations panel 5 for operating the inkjet copier 100 is controlled by the control part 60.

A head driving control part 71 controls the carriage 27 and the recording head (printing head) 28 via a head driver. A main scanning motor driving control part 72 controls the main scanning motor 12 via the main scanning motor driver so that movement of the carriage 27 in the main scanning direction is controlled. A sub scanning motor driving control part 73 controls the sub scanning motor 15 via the sub scanning motor driver so that a sub scanning driving part of, for example, the conveying belt 26 is controlled.

A conveying motor driving control part 74 controls a conveying motor 75 via a conveying motor driver so as to control the conveying rollers 24 or the paper discharge roller 29. A paper feeding clutch control part 75 controls connection or disconnection of the paper feeding clutch 76 so as to control driving the paper feeding roller 23.

Meanwhile, in an inside mechanism of the inkjet copier such as the paper conveying path, a rowel roller may be used as a paper conveying part. In a case where the user comes in contact with the rowel roller, the finger of the operator may be injured in the inkjet copier so that the finger may be damaged. In addition, the operator may be electrically shocked due to the operating voltage in the inkjet engine part. Therefore, in a case where the hand of the user may touch the inside mechanism, that is, in a case of an apparatus structure where the hand of the user may touch the inside mechanism when the cover provided in the inkjet copier is opened, it is necessary to prevent the user from being injured.

Because of this, in the inkjet copier 100 of this example, if the front cover 51 is opened, the carriage 27 starts returning to the home position HP, and the electric power of the paper conveying system (24 V system (group)) is turned off. If the engine cover 53 exposing the engine part is opened, the electric power of the 37 V system (group) is turned off.

Figure 6:
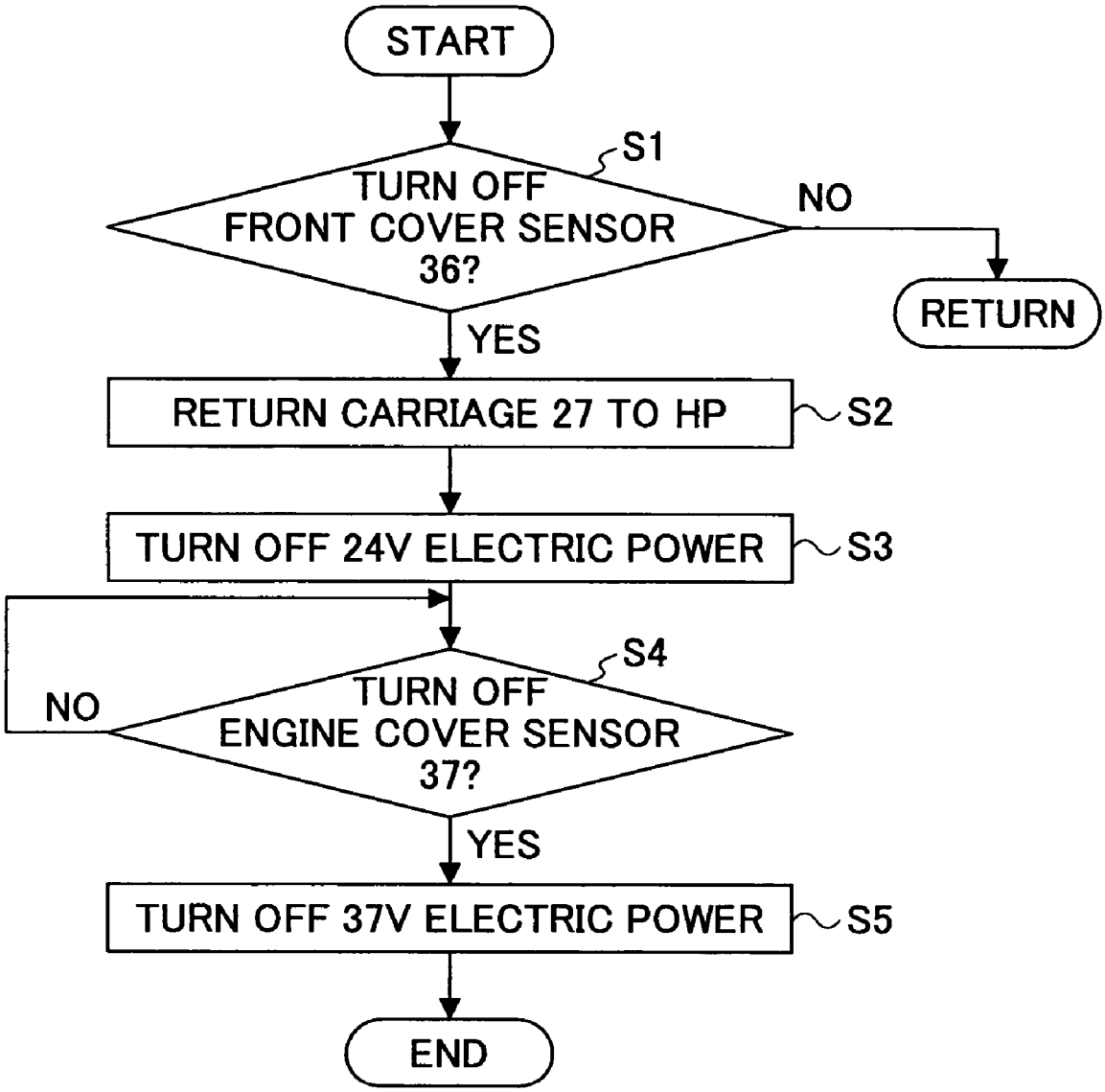
FIG. 6 is a flowchart showing an operation whereby the carriage is returned to the home position and control for turning off electric power.

FIG. 6 is a flowchart showing the above-mentioned control. In this flowchart, whether the cover sensor 36 is turned off is determined (S1). If the sensor 36 is turned off, the carriage 27 is returned to the home position (S2) and the electric power having 24 V of the paper conveying system is turned off (S3). Next, whether the engine cover sensor 37 is turned off is determined (S4). If the engine cover sensor 37 is not turned off, the step goes back to the step 4, and the electric power having 37 V is turned off when the engine cover sensor 37 is turned off (S5).

Furthermore, in this example, there is order in the opening and closing operations of the front cover 51, the conveying cover 52 and the engine cover 53. If the front cover 51 is not opened yet, the conveying cover 52 and the engine cover 53 cannot be opened. If the conveying cover 52 and the engine cover 53 are not closed yet, the front cover 51 cannot be closed. Therefore, regarding the operation for turning off the electric power, after the electric power having 24 V of the paper conveying system is turned off, the electric power having 37 V of the engine part is turned off. In addition, if the conveying cover 52 is not opened yet, the engine cover 53 cannot be opened. If the engine cover 53 is not closed yet, the conveying cover 52 cannot be closed.

According to an apparatus structure in this example, when the front cover 51 is opened, the ink cartridge installation part 30 is merely exposed and the hand of the operator cannot reach a movable part and a high voltage part and therefore no danger is present in this example. On the other hand, when the conveying cover 52 and the engine cover 53 are opened, a part of the engine 25 and a paper conveying path situated at a downstream side are exposed so that the hand of the operator may reach there. However, as discussed above, if the front cover 51 is opened, the electric power having 24 V of the paper conveying system is turned off. Hence, the conveying roller 24 or the like is stopped and therefore even if the conveying cover 51 is opened, the danger that the finger or the hand of the operator may be caught in the apparatus is avoided. Furthermore, in the engine 25, if the front cover 51 is opened, the carriage 27 starts returning to the home position HP and the electric power having 37 V is turned off by opening the engine cover 53. Hence, the danger of an electric shock at the engine part 25 can be avoided.

While the user opens the front cover 51, the conveying cover 52, and the engine cover 53 in this order, the carriage 27 returns to the home position HP. In this case, even if the electric power having 37 V is turned off by opening the engine cover 53, the electric power is not turned off before the carriage 27 returns to the home position HP. By determining the order of opening the covers, it is possible to make a time interval to return the carriage 27 to the home position HP. Hence, when the engine cover 53 positioned at an upper part of the engine part 25 is opened, the carriage 27 returns to the home position HP.

By returning the carriage 27 to the home position HP, the printing head 28 shown in FIG. 2 is sealed by the capping parts 16 and 17. Hence, even if the electric power having 37 V of the engine part 25 is off, it is possible to prevent the printing head from being kept exposed and to prevent the nozzle part of the printing head from becoming dry.

Figure 7:
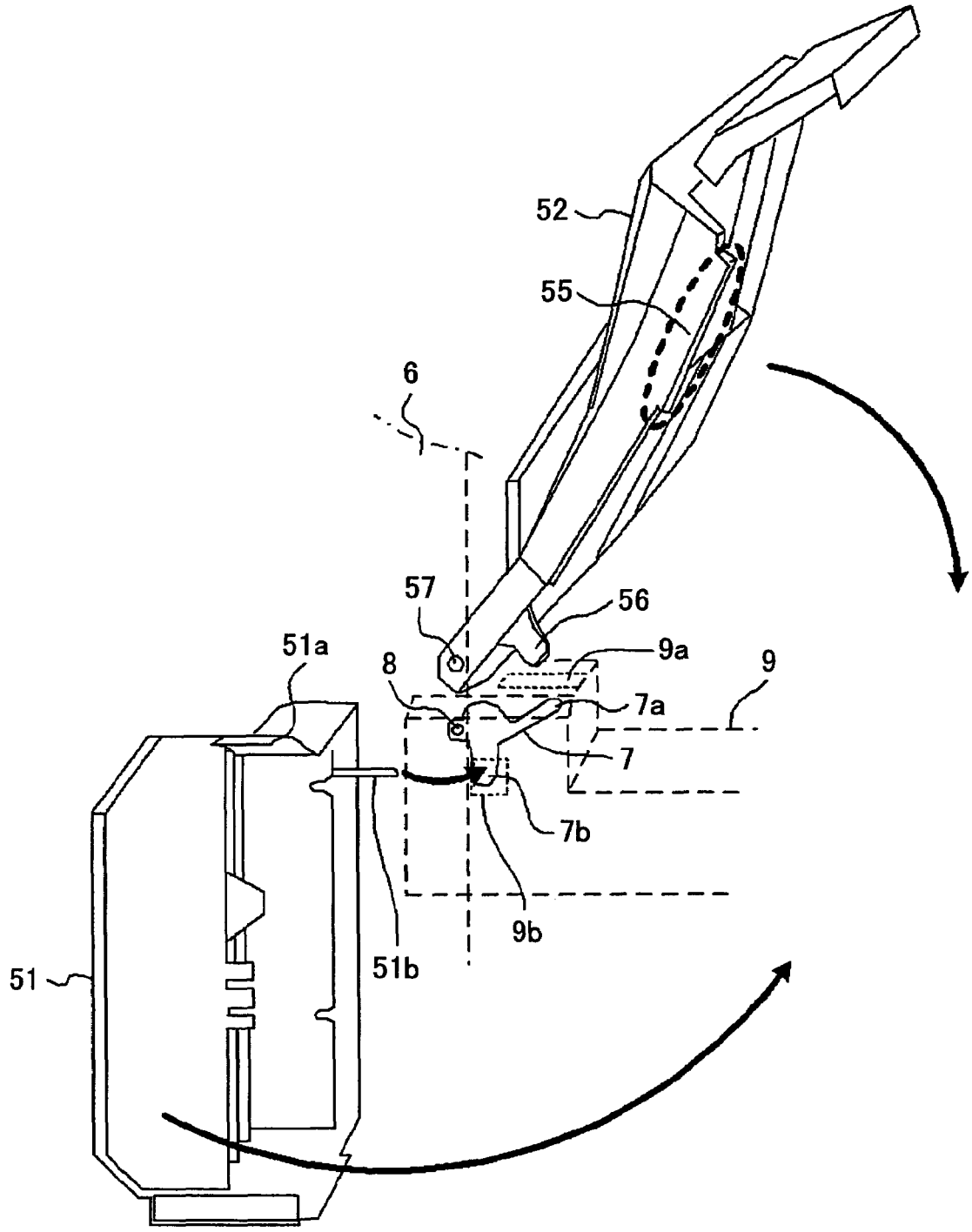
FIG. 7 is a partially enlarged view for explaining a structure for determining the order for opening and closing covers.

FIG. 7 is a partially enlarged view for explaining a structure for determining the order for opening and closing covers.

Referring to FIG. 7, the conveying cover 52 is rotatably supported with respect to a supporting shaft (horizontal shaft) 57. The front cover 51 is rotatably supported with respect to a supporting shaft (vertical shaft) not shown in FIG. 7. A projection part 55 projecting to a front side of the apparatus, namely a part surrounded by a dotted line in an elliptic manner, is formed at a right side of a front edge part of the conveying cover 52. The front cover 51 is formed in a box shape and has an upper side part 51*a* projecting to an inside. By closing the conveying cover 52 and the front cover 51, the upper side part 51*a* of the front cover 51 is overlapped on the projection part 55 of the conveying cover 52 so that the state shown in FIG. 1 can be achieved. That is, the projection part 55 of the conveying cover 52 is placed under the upper side part 51*a* of the front cover 51.

A pressing rib 56 which projects downward when the conveying cover 52 is closed is provided in the vicinity of the support shaft 57 and the front edge part of the conveying cover 52. A rotation rib is provided at a just lower part of the conveying cover 52. The rotation rib 7 is provided at a front stay 6 of an apparatus frame by the support shaft 8. Two projection sides 7*a* and 7*b* are formed in the rotation rib 7. An upper side projection side 7*a* is pushed by the pressing rib 56 when the conveying cover 52 is closed so that the rotation rib 7 is rotated clockwise in a state shown in FIG. 7. In a state where the conveying cover 52 is opened, the pressing rib 56 is separated from the rotation rib 7 and the rotation rib 7 is situated in a position shown in FIG. 7.

When the rotation rib is situated in a position shown in FIG. 7, if the front cover 51 is attempted to be closed, a projection stick 51*b* (a stick-shaped member which projects to a depth side of the apparatus when the front cover 51 is closed) formed in the front cover comes in contact with a projection side 7*b* of the rotation rib 7 so that the front cover 51 cannot be closed. By closing the conveying cover 52 so that the rotation rib 7 is rotated clockwise as shown in FIG. 7, the projection side 7*b* moves in a left direction. As a result of this, the projection stick 51*b* does not come in contact with the front cover 51 and therefore the front cover 51 can be closed. The rotation rib 7 is situated at an inside of an auxiliary stay 9 (See FIG. 3 and FIG. 7). The pressing rib 56 of the conveying cover 52 is inserted from an opening 9*a* situated at an upper surface of the auxiliary stay 9 and presses the projection side 7*a* of the rotation rib 7. When the rotation rib 7 is rotated, that is when the conveying cover 52 is closed, the projection stick 51*b* of the front cover 51 enters into the inside of the auxiliary stay 9 without coming in contact with the projection side 7*b* of the rotation rib 7 so that the front cover 51 is closed.

Under this structure, in a state shown in FIG. 1 where the front cover 51, the conveying cover 52 and the engine cover 53 are closed, even if the engine cover 53 is attempted to be opened first, the engine cover 53 cannot be opened because there is no area where the hand can be hung (inserted). In addition, even if the conveying cover 52 is attempted to be opened first, the conveying cover 52 cannot be opened because there is no area where the hand can be hung. In addition, since the projection part provided at a front edge part of the conveying cover 52 is pressed by the upper side part 51*a* of the front cover 51, it is not possible to open the conveying cover 52. Therefore, a structure where the front cover 51 among the front cover 51, the conveying cover 52, and the engine cover 53 can be opened first in a state show in FIG. 1 is formed.

Since the conveying cover 52 can be opened by opening the front cover 51, the conveying cover 52 is not opened before the electric power having 24 V of the paper conveying system is turned off. Therefore, it is possible to avoid the danger.

If the front cover 51 is opened first in a state shown in FIG. 1, the hand can be hung at the front edge part of the conveying cover 52 by using a space formed between a concave shaped part (See FIG. 3) of the auxiliary stay 9 and the conveying cover 52, so that the conveying cover 52 can be opened after the front cover 51. In addition, if the conveying cover 52 is opened, it is possible to hang the hand at a left end part, namely a side of the paper discharge roller side of the engine cover 53, so that the engine cover 53 can be opened after the conveying cover 52.

Thus, the order for opening the front cover 51, the conveying cover 52 and the engine cover 53 is determined. Therefore, the covers can be opened only in the order of the front cover 51, the conveying cover 52 and the engine cover 53. In a case where the carriage 27 starts returning to the home position HP by detecting the opening of the front cover 51, the carriage 27 is back to the home position HP when the engine cover 53 is situated at the upper part of the engine part and therefore the electric power having 37 V may be turned off. Under this structure, it is possible to eliminate the danger of electric shock due to the electric power having 37 V and to prevent the printing head from being dried. In addition, since the electric power having 24 V is turned off by detecting the opening of the front cover 51, when the conveying cover 52 is opened, the conveying part, such as the conveying roller 24 or the rowel roller, not shown, of the paper conveying path is stopped and therefore the danger of the hand of the user being caught in the apparatus so that the finger is injured is avoided.

Next, the determination of the order for closing covers is discussed.

When the conveying cover 52 and the engine cover 53 are closed, contacts part facing each other of the cover 52 and the engine cover 53 are closed and the head end part of the conveying part 52 is provided on the head end part of the engine cover 53. Hence, if the conveying cover 52 is closed first, the engine cover 53 cannot be closed completely. Therefore, the engine cover 53 should be closed first.

The front cover cannot be closed before the conveying cover 52 is closed because of the existence of the rotation rib 7. That is, since the front cover 51 can be closed by closing the conveying cover 52, the front cover 51 is not closed and the electric power of the paper conveying system is not turned on without closing the conveying cover 52. Hence, the danger can be eliminated.

In this example, the order for closing the covers is the engine cover 53->the conveying cover 52->the front cover 51. Even if the conveying cover 52 is closed and then the front cover 51 is closed so that the engine cover 53 keeps being opened, since the engine cover sensor 37 is turned off and the electric power having 37 V is turned off, the ink jet engine part 25 is not operated and therefore the danger can be eliminated.

Next, control of the side cover 54 shown in FIG. 1 and FIG. 3 is discussed. As described above, if the side cover 54 is opened, it is possible to access the paper conveying path from the paper feeding part 21 to the ink jet engine 25. In a case where jamming at this part is found, the side cover 54 should be opened for proper processing. Since there may be danger such that the finger is caught in the paper conveying path at this part or the hand can reach into the engine part 25 by opening the side cover 54, if a side cover detection sensor 38 detects that the side cover 54 is opened, the carriage 27 starts returning to the home position HP and the electric power having 24 V is turned off. After a designated time namely the time when the carriage 27 can be returned to the home position HP passes, the electric power having 37 V is turned off. Because of this, the danger at the paper conveying group at the time when the side cover 54 is opened is avoided and the danger of the electric shock at the time when the electric power having 37 V is turned off is avoided.

The present invention is not limited to the above-discussed embodiments, but variations and modifications may be made without departing from the scope of the present invention.

For example, the way for moving the carriage is not limited to the timing belt and may be a screw moving way. In addition, the number of ink colors is not limited to four but may be any number. Similarly, the number of the ink cartridge is not limited but may be the same number as the number of ink colors. The number of the head is not limited but may be any number. Furthermore, the recording paper conveying way at the ink jet engine part is not limited to the electrostatic attraction belt way of this example but may be any way such as a roller way. In addition, the number of steps of the paper feeding tray and the paper feeding cassette of the paper feeding part is not limited. Any type of sensor for detecting the opening and closing of the covers, such as a micro switch or photo sensor, can be used.

A structure, a location, and the number of the covers may be optional. For example, the carriage may be returned to the home position by detecting the opening of the cover covering a non-movable part of the apparatus such as a cover covering an operations button. In this case, following the cover covering the non-movable part, the danger when the paper conveying part and the engine part are disclosed may be avoided.

Under a structure where a paper reversing part is provided so that both surfaces can be recorded, in a case where the cover provided for the paper revering part is opened, the same control as the control for opening the side cover 54 of the above-mentioned examples may be provided.

A position where the ink cartridge installation part is provided is not limited to the position of the above-mentioned position but is optional. Control for having a relationship between one cover and another cover of the ink cartridge installation part may be used. That is, the carriage may be returned to the home position and the electric power having 24 V may be turned off when the cover of the ink cartridge installation part is opened. The electric power having 37 V may be turned off when other cover is opened. Furthermore, the same control as the control discussed above may be implemented by the cover of the ink cartridge installation part and the cover provided at the paper reversing part (both surface parts).

Furthermore, the operating voltage is not limited to 24 V and 37 V but may be optional. Three or more voltages may be used. The present invention can be applied in a case where the operating voltage is changed.

A structure of the scanner part or the existence of an ADF is optional. As an image forming apparatus, a printer not having the scanner part or a printer having a FAX function may be used.

This patent application is based on Japanese Priority Patent Application No. 2004-244961 filed on Aug. 25, 2004, the entire contents of which are hereby incorporated by reference.

What is claimed is:

1. An inkjet recording apparatus, comprising:

a carriage having a printing head and moving in a main scanning direction;

an exterior cover;

a detection part configured to detect an opening or closing state of the exterior cover; and a conveying part cover configured to open at least a part of a paper conveying path;

wherein the carriage is returned to a home position and electric power of a paper conveying group is turned off when opening of the exterior cover is detected, and wherein opening of the conveying part cover becomes available by opening the exterior cover.

2. The inkjet recording apparatus as claimed in claim 1, wherein the exterior cover is a cover covering a non-movable part of the inkjet recording apparatus.

3. The inkjet recording apparatus as claimed in claim 1, wherein the exterior cover is a cover for exchanging an ink cartridge.

4. The inkjet recording apparatus as claimed in claim 3, wherein the ink cartridge is provided separately from the printing head; and the exterior cover covers an installation part of the ink cartridge.

5. The inkjet recording apparatus as claimed in claim 1, wherein the exterior cover includes a pressing part configured to press a part of the conveying part cover from an outside; and opening of the conveying part cover becomes available by opening the exterior cover.

6. The inkjet recording apparatus as claimed in claim 1, wherein closing of the exterior cover becomes available by closing the conveying part cover.

7. The inkjet recording apparatus as claimed in claim 6, further comprising:

a member configured to move between a contact position where the exterior cover comes in contact with the member so that the exterior cover cannot be closed and a save position where the exterior cover does not come in contact with the member so that the exterior cover can be closed;

wherein the member is moved to the save position by the closing of the conveying part cover; and the member moves to the contact position by the opening of the conveying part cover.

8. The inkjet recording apparatus as claimed in claim 1, further comprising:

an engine part cover configured to open at least a part of an inkjet engine part;

wherein electric power of the engine part is turned off when the engine part cover is opened.

9. The inkjet recording apparatus as claimed in claim 1, further comprising:

an engine part cover configured to open at least a part of an inkjet engine part;

wherein electric power of the engine part is turned off when the engine part cover is opened; and the order of opening of the exterior cover, the conveying part cover, and the engine part cover is determined.

10. The inkjet recording apparatus as claimed in claim 9, wherein the carriage is returned to the home position when the engine part cover is opened.

11. The inkjet recording apparatus as claimed in claim 1, further comprising:

a side cover configured to open a paper conveying path from a paper feeding part to an inkjet engine part, and a part of the inkjet engine part;

wherein the carriage is returned to a home position in a case where the side cover is opened.

12. The inkjet recording apparatus as claimed in claim 11, wherein electric power of the inkjet engine part is turned off after a designated time is passed from opening of the side cover.

13. The inkjet recording apparatus as claimed in claim 12, wherein the designated time is a time when the carriage can be returned to the home position.

14. A control method of an inkjet recording apparatus, the inkjet recording apparatus including a carriage having a printing head and moving in a main scanning direction, an exterior cover configured to open an ink cartridge installation part, a detection part configured to detect an opening or closing state of the exterior cover, and a conveying part cover configured to open at least a part of a paper conveying path, the control method comprising the step of:

returning the carriage to a home position and turning off electric power of a paper conveying group when opening of the exterior cover is detected by the detection part; and wherein opening of the conveying part cover becomes available by opening the exterior cover.

15. The control method of the inkjet recording apparatus as claimed in claim 14, wherein the inkjet recording apparatus includes a cover for a jam clearing process; and electric power of a paper conveying group is turned off when the exterior cover is opened.

16. The control method of the inkjet recording apparatus as claimed in claim 14, wherein the inkjet recording apparatus includes an engine part cover configured to open at least a part of the inkjet engine part;

wherein electric power of the engine part is turned off when the engine part cover is opened.

* * * * *